US011035146B1

(12) United States Patent
Bernard et al.

(10) Patent No.: US 11,035,146 B1
(45) Date of Patent: Jun. 15, 2021

(54) CAMPER-ATTACHED PRIVACY TENT

(71) Applicants: Edgar Bernard, Leominster, MA (US); Kristen Bernard, Leominster, MA (US)

(72) Inventors: Edgar Bernard, Leominster, MA (US); Kristen Bernard, Leominster, MA (US)

( * ) Notice: Subject to any disclaimer, the term of this patent is extended or adjusted under 35 U.S.C. 154(b) by 277 days.

(21) Appl. No.: 16/253,331

(22) Filed: Jan. 22, 2019

(51) Int. Cl.
*E04H 15/44* (2006.01)
*E04H 15/06* (2006.01)
*E04H 15/04* (2006.01)

(52) U.S. Cl.
CPC ..... *E04H 15/44* (2013.01); *E04H 15/04* (2013.01); *E04H 15/06* (2013.01)

(58) Field of Classification Search
CPC ..... E04H 15/00; E04H 15/44
USPC ..... 135/141, 142, 156, 157
See application file for complete search history.

(56) References Cited

U.S. PATENT DOCUMENTS 873,038 A * 12/1907 Garret ..... E04H 15/42 135/156
1,940,147 A * 12/1933 Sankus ..... E04H 15/00 135/157
2,151,908 A * 3/1939 Gottlieb ..... E04B 1/3441 135/136
2,723,673 A * 11/1955 Call ..... E04H 15/46 135/140
2,771,896 A * 11/1956 Call ..... E04H 15/48 135/140
2,913,029 A * 11/1959 Paton ..... B65D 90/046 220/9.2
3,263,692 A * 8/1966 Questi ..... E04H 15/44 135/158
3,454,021 A * 7/1969 Morris ..... E04H 15/42 135/156
3,810,482 A 5/1974 Beavers
3,968,809 A 7/1976 Beavers
4,065,166 A 12/1977 Shoemaker
4,077,418 A * 3/1978 Cohen ..... E04H 15/48 135/118
4,222,604 A 9/1980 Human
5,167,246 A * 12/1992 Mortenson ..... E04H 15/48 135/143
6,971,707 B1 12/2005 Mullan
D522,922 S 6/2006 Swails
2006/0213546 A1* 9/2006 Mitsui ..... E04H 15/42 135/121

(Continued)

FOREIGN PATENT DOCUMENTS

CA 981143 1/1976

*Primary Examiner* — Noah Chandler Hawk

(57) ABSTRACT

The camper-attached privacy tent is configured for use with a trailer. The camper-attached privacy tent is a structure that encloses the negative space of the trailer. The span of the length of the vertical direction of the camper-attached privacy tent is adjustable such that the camper-attached privacy tent adjusts to match variations in the span of the vertical direction of the negative space between different trailers. The span of the length of the primary sense of direction of the camper-attached privacy tent is adjustable such that the camper-attached privacy tent adjusts to match variations in the span of the primary sense of direction of the negative space between different trailers.

11 Claims, 7 Drawing Sheets

(56) References Cited

U.S. PATENT DOCUMENTS

| | | | |
|---|---|---|---|
| 2007/0120396 | A1 | 5/2007 | Rheinheimer |
| 2010/0269875 | A1 | 10/2010 | Notermann |

* cited by examiner

CAMPER-ATTACHED PRIVACY TENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of transportation and vehicles including vehicles adapted to special loads, more specifically, a detail for a vehicle comprising living accommodations for people. (B60P3/36)

A trailer 105 is an enclosed, unpowered and towed vehicle. The trailer 105 is configured for use with a pickup truck. The trailer 104 is towed by the pickup truck as the trailer 104 is towed by the pickup truck. The trailer 104 further comprises an elevated component 105. The elevated component 105 forms a negative space 106 that allows for the positioning of the bed of the pickup truck underneath the elevated component 105. The negative space 106 is bounded by the trailer 104 and the perimetrical boundary of the trailer 104. The negative space 106 is further defined with a vertical direction 171, a lateral direction 173, and a primary sense of direction 172.

One shortcoming of the trailer 104 is that the negative space 106 is an unusable space within the perimetrical boundary of the trailer 104 when the pickup truck is not towing the trailer 104. Clearly, a method to use the negative space 106 in these circumstances would have value.

SUMMARY OF INVENTION

The camper-attached privacy tent addresses the above shortcoming of a trailer.

The camper-attached privacy tent is configured for use with a trailer. The camper-attached privacy tent is a structure that encloses the negative space of the trailer. The span of the length of the vertical direction of the camper-attached privacy tent is adjustable such that the camper-attached privacy tent adjusts to match variations in the span of the vertical direction of the negative space between different trailers. The span of the length of the primary sense of direction of the camper-attached privacy tent is adjustable such that the camper-attached privacy tent adjusts to match variations in the span of the primary sense of direction of the negative space between different trailers. The span of the length of the lateral direction of the camper-attached privacy tent is adjustable such that the camper-attached privacy tent adjusts to match variations in the span of the lateral direction of the negative space between different trailers.

The camper-attached privacy tent comprises a framework, a tarpaulin, and a plurality of fasteners. The plurality of fasteners attach the tarpaulin to the framework. The framework forms a containment space within the boundaries of the negative space. The span of the length of the framework in the vertical direction is adjustable. The span of the length of the framework in the primary sense of direction is adjustable. The span of the length of the framework in the lateral direction is adjustable. The tarpaulin is an opaque sheeting that blocks visibility into the containment space formed by the framework.

These together with additional objects, features and advantages of the camper-attached privacy tent will be readily apparent to those of ordinary skill in the art upon reading the following detailed description of the presently preferred, but nonetheless illustrative, embodiments when taken in conjunction with the accompanying drawings.

In this respect, before explaining the current embodiments of the camper-attached privacy tent in detail, it is to be understood that the camper-attached privacy tent is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the camper-attached privacy tent.

It is therefore important that the claims be regarded as including such equivalent construction insofar as they do not depart from the spirit and scope of the camper-attached privacy tent. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
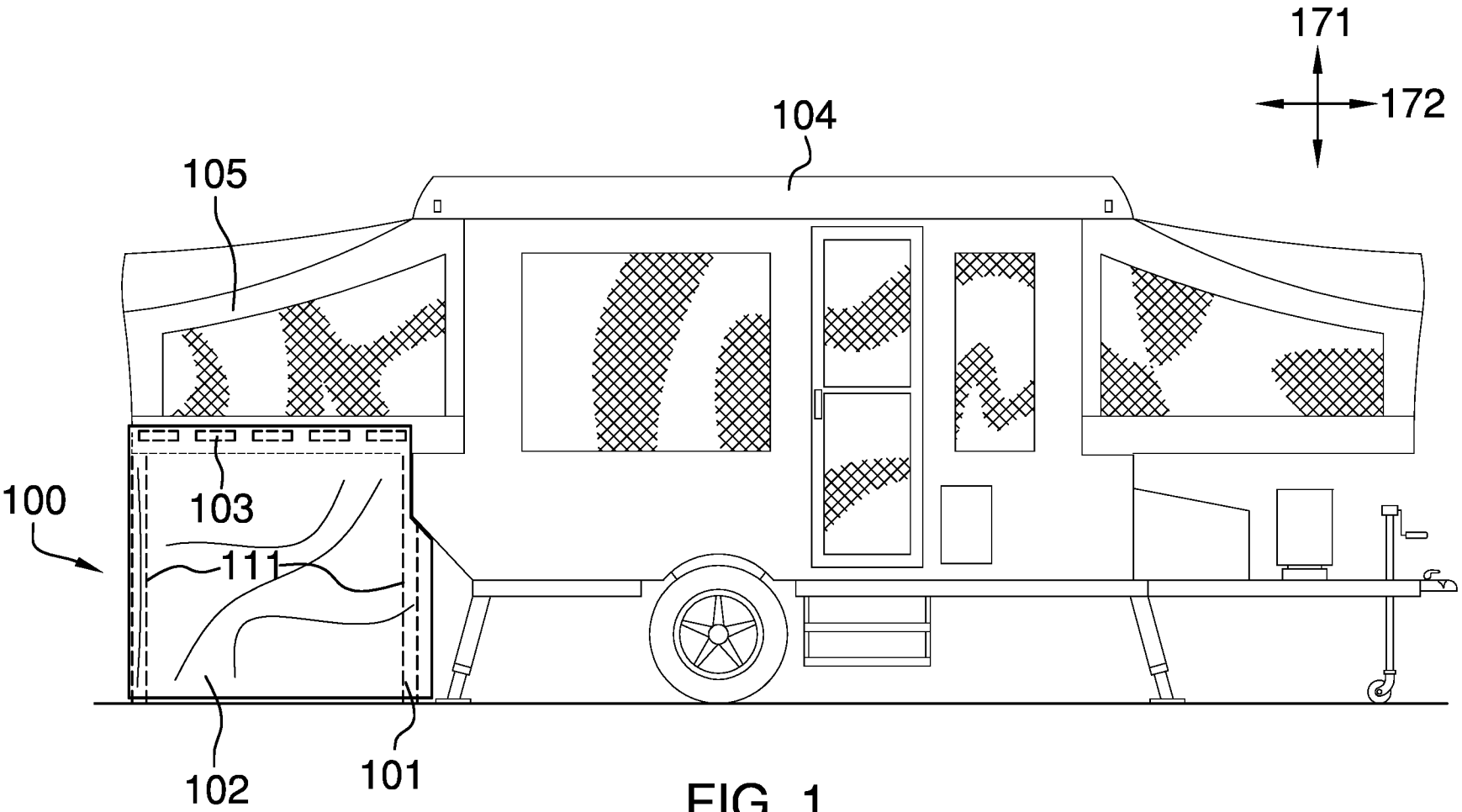
FIG. 1 is a side view of an embodiment of the disclosure.
Figure 2:
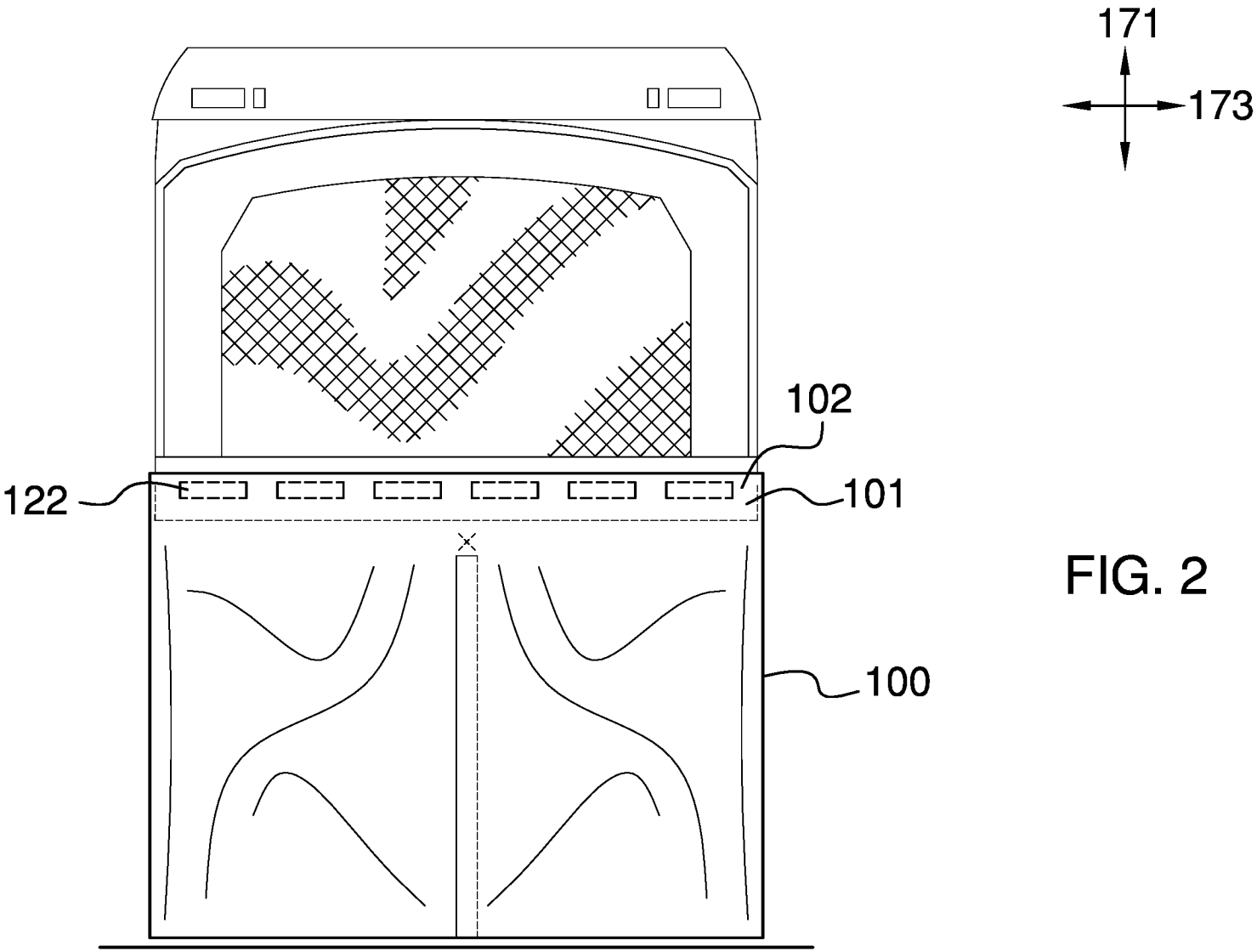
FIG. 2 is a front view of an embodiment of the disclosure.
Figure 4:
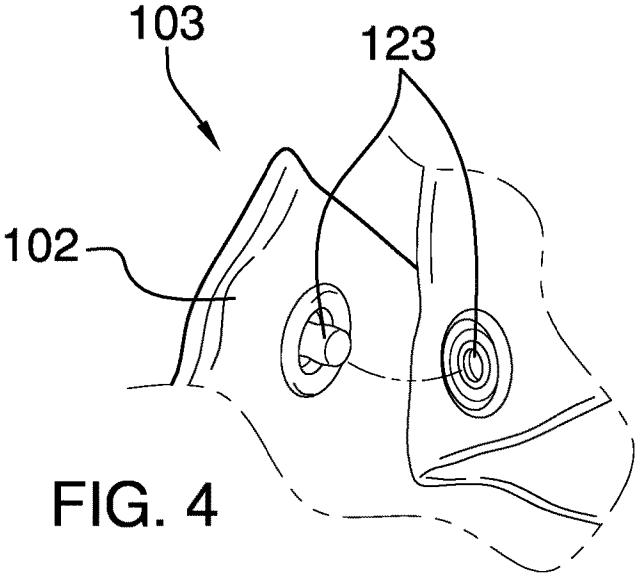
FIG. 4 is a detail view of an embodiment of the disclouser.
Figure 3:
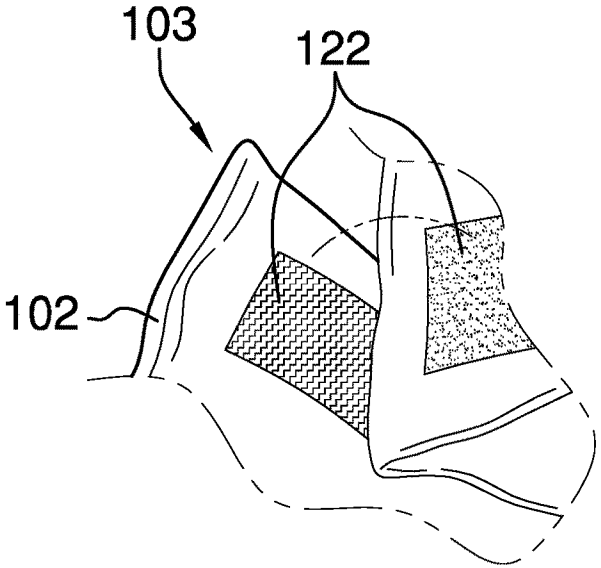
FIG. 3 is a detail view of an embodiment of the disclosure.
Figure 5:
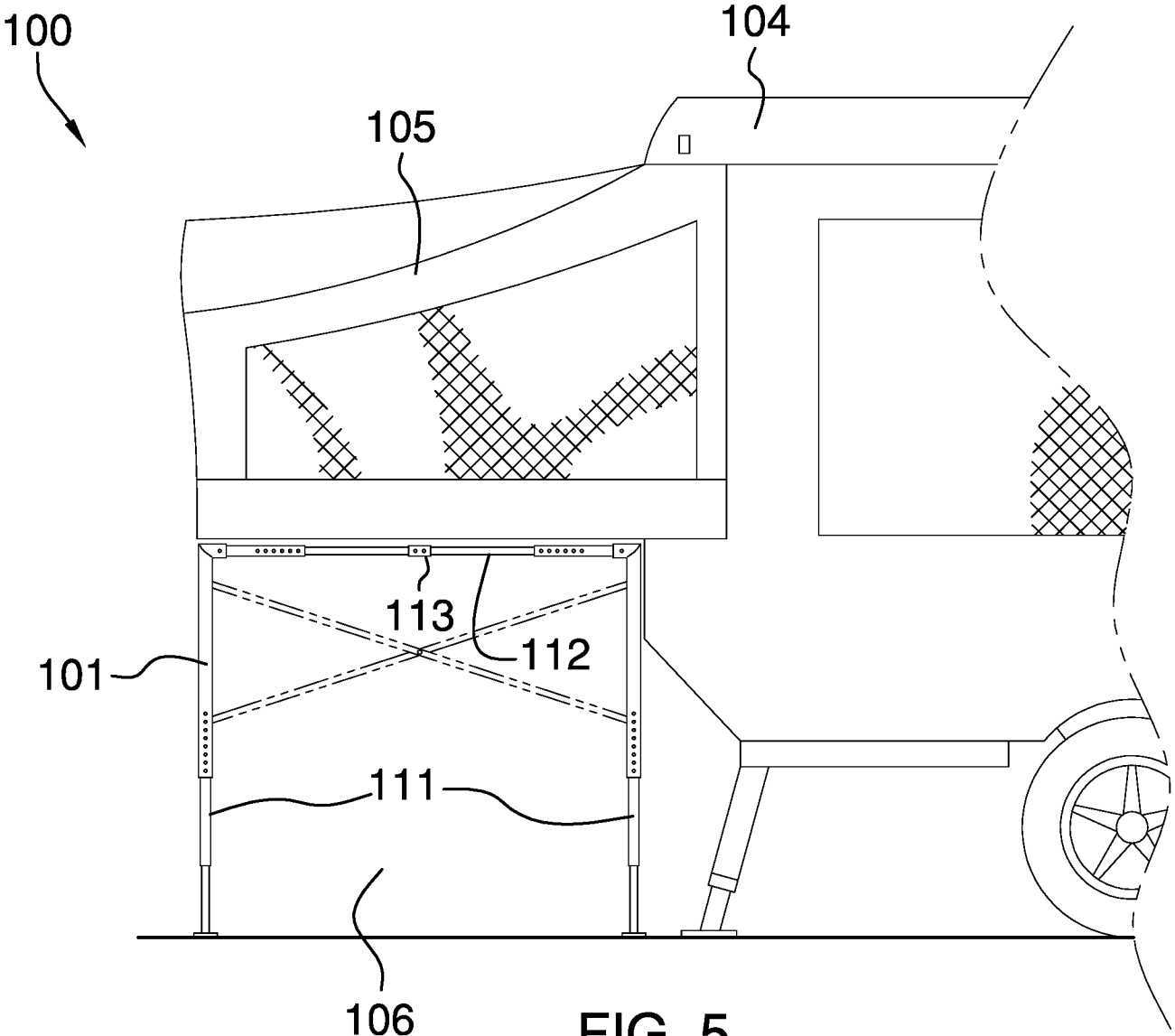
FIG. 5 is a side view of an embodiment of the disclosure.
Figure 6:
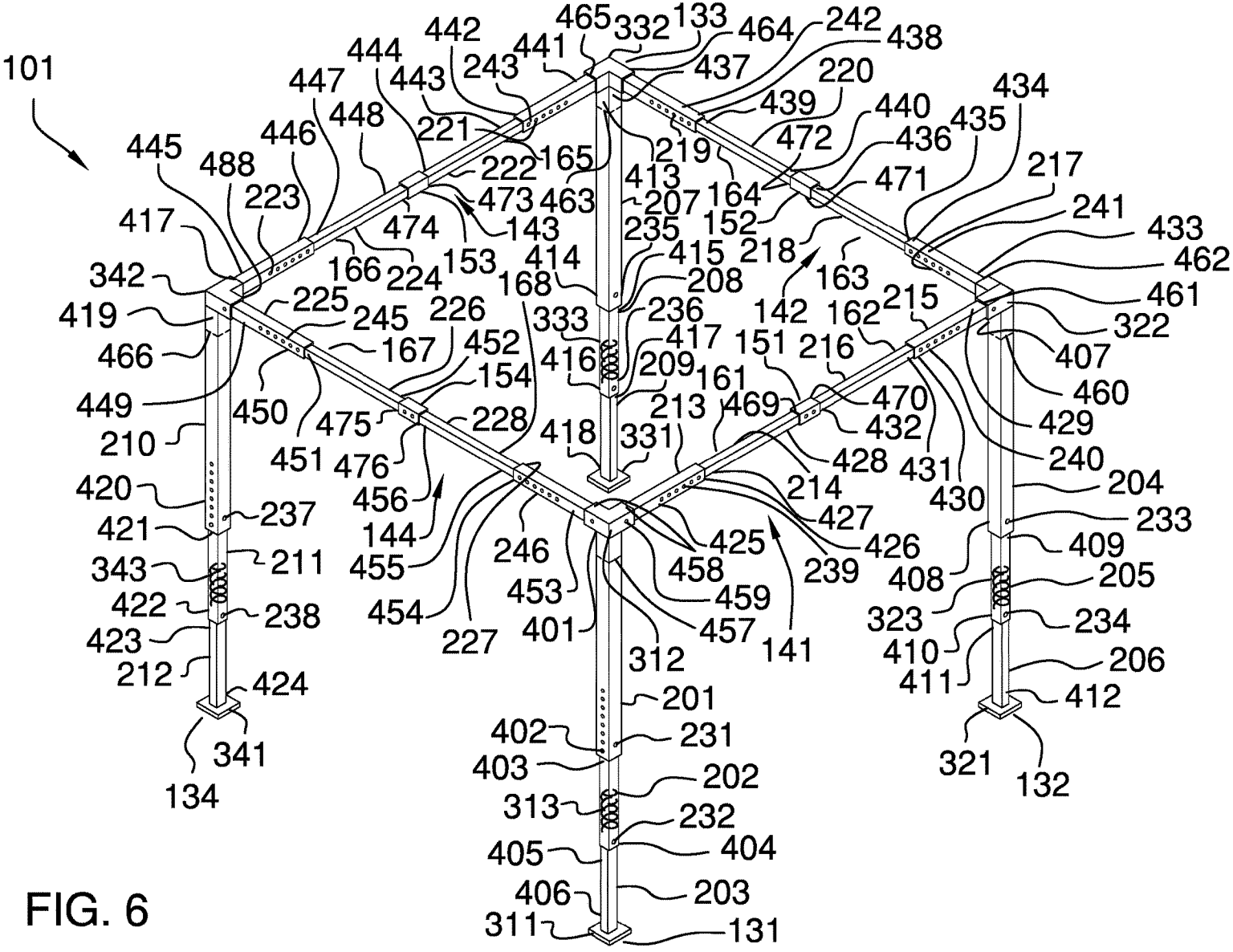
FIG. 6 is a perspective view of an embodiment of the disclosure.
Figure 7:
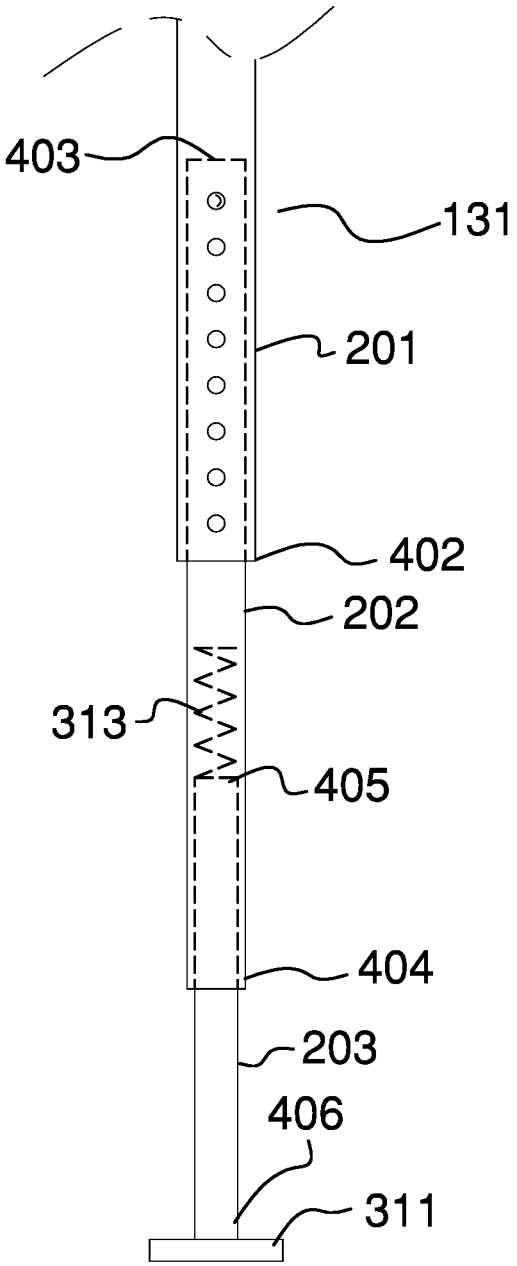
FIG. 7 is a detail view of an embodiment of the disclosure.
Figure 8:
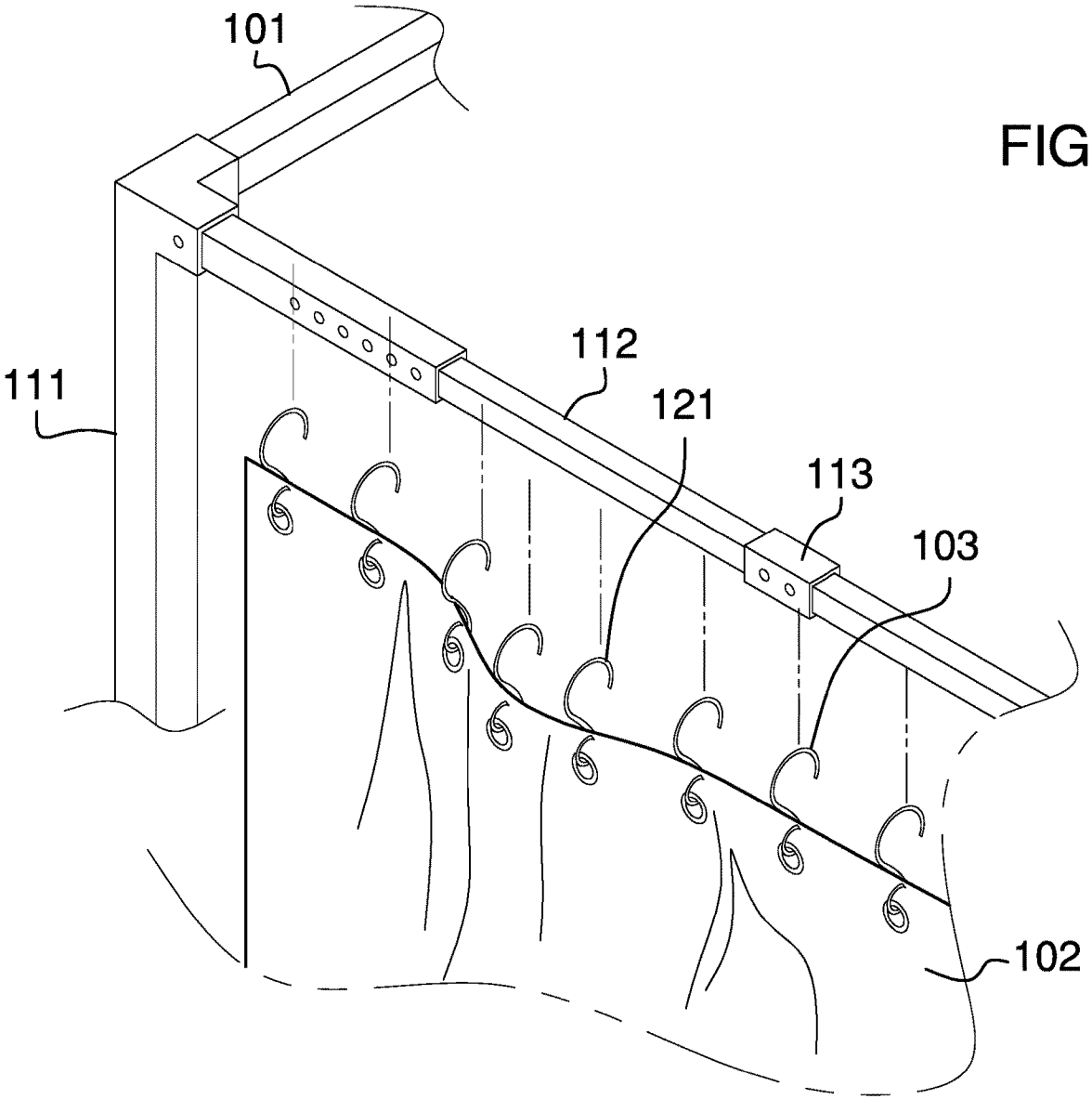
FIG. 8 is a detail view of an embodiment of the disclosure.

Detailed reference will now be made to one or more potential embodiments of the disclosure, which are illustrated in FIGS. 1 through 8.

The camper-attached privacy tent 100 (hereinafter invention) is configured for use with a trailer 104. The invention 100 is a structure that encloses the negative space 106 of the trailer 104. The span of the length of the vertical direction 171 of the invention 100 is adjustable such that the invention 100 adjusts to match variations in the span of the vertical direction 171 of the negative space 106 between different trailers 104. The span of the length of the primary sense of direction 172 of the invention 100 is adjustable such that the invention 100 adjusts to match variations in the span of the primary sense of direction 172 of the negative space 106 between different trailers 104. The span of the length of the lateral direction 173 of the invention 100 is adjustable such that the invention 100 adjusts to match variations in the span of the lateral direction 173 of the negative space 106 between different trailers 104.

The invention 100 comprises a framework 101, a tarpaulin 102, and a plurality of fasteners 103. The plurality of fasteners 103 attach the tarpaulin 102 to the framework 101. The framework 101 forms a containment space within the boundaries of the negative space 106. The span of the lenght the framework 101 in the vertical direction 171 is adjustable. The span of the length of the framework 101 in the primary sense of direction 172 is adjustable. The span of the length of the framework 101 in the lateral direction 173 is adjustable. The tarpaulin 102 is an opaque sheeting that blocks visibility into the containment space formed by the framework 101.

The vertical direction 171 is defined in greater detail elsewhere in this disclosure. The primary sense of direction 172 is defined in greater detail elsewhere in this disclosure. The lateral direction 173 is defined in greater detail elsewhere in this disclosure.

The tarpaulin 102 is a sheeting. The tarpaulin 102 is formed from an opaque material. The tarpaulin 102 attaches to the framework 101 such that the tarpaulin 102 prevents visibility into the containment space formed by the framework 101.

Each of the plurality of fasteners 103 suspends the tarpaulin 102 from the framework 101. Each of the plurality of fasteners 103 forms a portion of the load path the transfers the load of the tarpaulin 102 to the framework 101. Each of the plurality of fasteners 103 is selected from the group consisting of a plurality of hooks 121, a plurality of hook and loop fasteners 122, and a plurality of snaps 123.

Each of the plurality of hooks 121 is a hook. Each of the plurality of hooks 121 suspends the tarpaulin 102 from a beam selected from the plurality of beams 112. The hook is defined in greater detail elsewhere in this disclosure.

Each of the plurality of hook and loop fasteners 122 is a hook. Each of the plurality of hook and loop fasteners 122 suspends the tarpaulin 102 from a beam selected from the plurality of beams 112. The hook and loop fastener is defined in greater detail elsewhere in this disclosure.

Each of the plurality of snaps 123 is a snap. Each of the plurality of snaps 123 suspends the tarpaulin 102 from a beam selected from the plurality of beams 112. The snap is defined in greater detail elsewhere in this disclosure.

The framework 101 is an openwork structure. The framework 101 forms the boundary of the containment space. The framework 101 forms a substructure that supports the tarpaulin 102. The span of the length of the framework 101 in the vertical direction 171 is adjustable. The framework 101 in the primary sense of direction 172 is adjustable. The framework 101 in the lateral direction 173 is adjustable. The span of the lengths of the framework 101 adjusts such that the framework 101 will fit within the negative space 106 underneath the elevated component 105 of the trailer 104. The framework 101 comprises a plurality of telescopic stanchions 111, a plurality of beams 112, and a plurality of beam links 113.

Each of the plurality of telescopic stanchions 111 is a vertically oriented structure. Each of the plurality of telescopic stanchions 111 is a telescopic structure. The span of the length of each of the plurality of telescopic stanchions 111 is adjustable in the vertical direction 171. The plurality of telescopic stanchions 111 forms the load path that transfers the combined load of the plurality of beams 112, the plurality of beam links 113, and the tarpaulin 102 to the ground. The plurality of telescopic stanchions 111 comprises a first telescopic stanchion 131, a second telescopic stanchion 132, a third telescopic stanchion 133, and a fourth telescopic stanchion 134.

The first telescopic stanchion 131 is a vertically oriented stanchion that carries a portion of the load path of the invention 100. The first telescopic stanchion 131 is a telescopic structure.

The first telescopic stanchion 131 comprises a first arm 201, a second arm 202, and a first detent 231. The first detent 231 is a mechanical device that locks and secures the second arm 202 to the first arm 201. The first arm 201 is a hollow prism that is further defined with an inner dimension. The second arm 202 is a hollow prism that is further defined with an outer dimension. The second arm 202 is geometrically similar to the first arm 201. The span of the outer dimension of the second arm 202 is lesser than the span of the inner dimension of the first arm 201 such that the second arm 202 inserts into the first arm 201 in a telescopic fashion.

This telescopic arrangement of the first telescopic stanchion 131 allows the length of the first telescopic stanchion 131 to adjust by adjusting the relative position of the second arm 202 within the first arm 201. The position of the second arm 202 relative to the first arm 201 is held in position using the first detent 231. The first detent 231 is selected from the group consisting of a cotter pin, a G snap collar, a cam lock collar, a threaded clutch, a split collar lock, and a spring-loaded ball lock.

The first telescopic stanchion 131 further comprises a third arm 203, and a second detent 232. The second detent 232 is a mechanical device that locks and secures the second arm 202 to the third arm 203. The third arm 203 is a hollow prism that is further defined with an outer dimension. The third arm 203 is geometrically similar to the second arm 202. The span of the outer dimension of the third arm 203 is lesser than the span of the inner dimension of the second arm 202 such that the third arm 203 inserts into the second arm 202 in a telescopic fashion.

This telescopic arrangement of the first telescopic stanchion 131 allows the length of the first telescopic stanchion 131 to adjust by adjusting the relative position of the third arm 203 within the second arm 202. The position of the relative to the third arm 203 is held in position using the second detent 232. The second detent 232 is selected from the group consisting of a cotter pin, a G snap collar, a cam lock collar, a threaded clutch, a split collar lock, and a spring-loaded ball lock.

The first telescopic stanchion 131 further comprises a first plate 311, a first 90-degree elbow tee 312, and a first compression spring 313. The first plate 311 is a disk-shaped plate structure. The first plate 311 forms a pedestal between the third arm 203 of the first telescopic stanchion 131 and the ground. The first 90-degree elbow tee 312 is an elbow tee that forms the superior structure of the first telescopic stanchion 131. The first 90-degree elbow tee 312 attaches the first arm 201 of the first telescopic stanchion 131 to the first beam 141 and the fourth beam 144. The first compression spring 313 is a helical spring. The first compression spring 313 is a coil spring that forms a compression spring. The first compression spring 313 absorbs shocks within the first telescopic stanchion 131 that occur when the framework 101 installs in the negative space 106.

The second telescopic stanchion 132 is a vertically oriented stanchion that carries a portion of the load path of the invention 100. The second telescopic stanchion 132 is a telescopic structure.

The second telescopic stanchion 132 comprises a fourth arm 204, a fifth arm 205, and a third detent 233. The third detent 233 is a mechanical device that locks and secures the fifth arm 205 to the fourth arm 204. The fourth arm 204 is a hollow prism that is further defined with an inner dimension. The fifth arm 205 is a hollow prism that is further defined with an outer dimension. The fifth arm 205 is geometrically similar to the fourth arm 204. The span of the outer dimension of the fifth arm 205 is lesser than the span of the inner dimension of the fourth arm 204 such that the fifth arm 205 inserts into the fourth arm 204 in a telescopic fashion.

This telescopic arrangement of the second telescopic stanchion 132 allows the length of the second telescopic stanchion 132 to adjust by adjusting the relative position of the fifth arm 205 within the fourth arm 204. The position of the fifth arm 205 relative to the fourth arm 204 is held in position using the third detent 233. The third detent 233 is selected from the group consisting of a cotter pin, a G snap collar, a cam lock collar, a threaded clutch, a split collar lock, and a spring-loaded ball lock.

The second telescopic stanchion 132 further comprises a sixth arm 206, and a fourth detent 234. The fourth detent 234 is a mechanical device that locks and secures the fifth arm 205 to the sixth arm 206. The fifth arm 205 is a hollow prism that is further defined with an inner dimension. The sixth arm 206 is a hollow prism that is further defined with an outer dimension. The sixth arm 206 is geometrically similar to the fifth arm 205. The span of the outer dimension of the fifth arm 205 is lesser than the span of the inner dimension of the sixth arm 206 such that the sixth arm 206 inserts into the fifth arm 205 in a telescopic fashion.

This telescopic arrangement of the second telescopic stanchion 132 allows the length of the second telescopic stanchion 132 to adjust by adjusting the relative position of the sixth arm 206 within the fifth arm 205. The position of the fifth arm 205 relative to the sixth arm 206 is held in position using the fourth detent 234. The fourth detent 234 is selected from the group consisting of a cotter pin, a G snap collar, a cam lock collar, a threaded clutch, a split collar lock, and a spring-loaded ball lock.

The second telescopic stanchion 132 further comprises a second plate 321, a second 90-degree elbow tee 322, and a second compression spring 323. The second plate 321 is a disk-shaped plate structure. The second plate 321 forms a pedestal between the sixth arm 206 of the second telescopic stanchion 132 and the ground. The second 90-degree elbow tee 322 is an elbow tee that forms the superior structure of the second telescopic stanchion 132. The second 90-degree elbow tee 322 attaches the fourth arm 204 of the second telescopic stanchion 132 to the second beam 142 and the first beam 141. The second compression spring 323 is a helical spring. The second compression spring 323 is a coil spring that forms a compression spring. The second compression spring 323 absorbs shocks within the second telescopic stanchion 132 that occur when the framework 101 installs in the negative space 106.

The third telescopic stanchion 133 is a vertically oriented stanchion that carries a portion of the load path of the invention 100. The third telescopic stanchion 133 is a telescopic structure.

The third telescopic stanchion 133 comprises a seventh arm 207, an eighth arm 208, and a fifth detent 235. The fifth detent 235 is a mechanical device that locks and secures the eighth arm 208 to the seventh arm 207. The seventh arm 207 is a hollow prism that is further defined with an inner dimension. The eighth arm 208 is a hollow prism that is further defined with an outer dimension. The eighth arm 208 is geometrically similar to the seventh arm 207. The span of the outer dimension of the eighth arm 208 is lesser than the span of the inner dimension of the seventh arm 207 such that the eighth arm 208 inserts into the seventh arm 207 in a telescopic fashion.

This telescopic arrangement of the third telescopic stanchion 133 allows the length of the third telescopic stanchion 133 to adjust by adjusting the relative position of the eighth arm 208 within the seventh arm 207. The position of the eighth arm 208 relative to the seventh arm 207 is held in position using the fifth detent 235. The fifth detent 235 is selected from the group consisting of a cotter pin, a G snap collar, a cam lock collar, a threaded clutch, a split collar lock, and a spring-loaded ball lock.

The third telescopic stanchion 133 further comprises a ninth arm 209, and a sixth detent 236. The sixth detent 236 is a mechanical device that locks and secures the eighth arm 208 to the ninth arm 209. The eighth arm 208 is a hollow prism that is further defined with an inner dimension. The ninth arm 209 is a hollow prism that is further defined with an outer dimension. The ninth arm 209 is geometrically similar to the eighth arm 208. The span of the outer dimension of the eighth arm 208 is lesser than the span of the inner dimension of the ninth arm 209 such that the ninth arm 209 inserts into the eighth arm 208 in a telescopic fashion.

This telescopic arrangement of the third telescopic stanchion 133 allows the length of the third telescopic stanchion 133 to adjust by adjusting the relative position of the ninth arm 209 within the eighth arm 208. The position of the eighth arm 208 relative to the ninth arm 209 is held in position using the sixth detent 236. The sixth detent 236 is selected from the group consisting of a cotter pin, a G snap collar, a cam lock collar, a threaded clutch, a split collar lock, and a spring-loaded ball lock.

The third telescopic stanchion 133 further comprises a third plate 331, a third 90-degree elbow tee 332, and a third compression spring 333. The third plate 331 is a disk-shaped plate structure. The third plate 331 forms a pedestal between the ninth arm 209 of the third telescopic stanchion 133 and the ground. The third 90-degree elbow tee 332 is an elbow tee that forms the superior structure of the third telescopic stanchion 133. The third 90-degree elbow tee 332 attaches the seventh arm 207 of the third telescopic stanchion 133 to the third beam 143 and the second beam 142. The third compression spring 333 is a helical spring. The third compression spring 333 is a coil spring that forms a compression spring. The third compression spring 333 absorbs shocks within the third telescopic stanchion 133 that occur when the framework 101 installs in the negative space 106.

The fourth telescopic stanchion 134 is a vertically oriented stanchion that carries a portion of the load path of the invention 100. The fourth telescopic stanchion 134 is a telescopic structure.

The fourth telescopic stanchion 134 comprises a tenth arm 210, an eleventh arm 211, and a seventh detent 237. The seventh detent 237 is a mechanical device that locks and secures the eleventh arm 211 to the tenth arm 210. The tenth arm 210 is a hollow prism that is further defined with an inner dimension. The eleventh arm 211 is a hollow prism that is further defined with an outer dimension. The eleventh arm 211 is geometrically similar to the tenth arm 210. The span of the outer dimension of the eleventh arm 211 is lesser than the span of the inner dimension of the tenth arm 210 such that the eleventh arm 211 inserts into the tenth arm 210 in a telescopic fashion.

This telescopic arrangement of the fourth telescopic stanchion 134 allows the length of the fourth telescopic stanchion 134 to adjust by adjusting the relative position of the eleventh arm 211 within the tenth arm 210. The position of the eleventh arm 211 relative to the tenth arm 210 is held in position using the seventh detent 237. The seventh detent 237 is selected from the group consisting of a cotter pin, a G snap collar, a cam lock collar, a threaded clutch, a split collar lock, and a spring-loaded ball lock.

The fourth telescopic stanchion 134 further comprises a twelfth arm 212, and an eighth detent 238. The eighth detent 238 is a mechanical device that locks and secures the eleventh arm 211 to the twelfth arm 212. The eleventh arm 211 is a hollow prism that is further defined with an inner dimension. The twelfth arm 212 is a hollow prism that is further defined with an outer dimension. The twelfth arm 212 is geometrically similar to the eleventh arm 211. The span of the outer dimension of the eleventh arm 211 is lesser than the span of the inner dimension of the twelfth arm 212 such that the twelfth arm 212 inserts into the eleventh arm 211 in a telescopic fashion.

This telescopic arrangement of the fourth telescopic stanchion 134 allows the length of the fourth telescopic stanchion 134 to adjust by adjusting the relative position of the twelfth arm 212 within the eleventh arm 211. The position of the eleventh arm 211 relative to the twelfth arm 212 is held in position using the eighth detent 238. The eighth detent 238 is selected from the group consisting of a cotter pin, a G snap collar, a cam lock collar, a threaded clutch, a split collar lock, and a spring-loaded ball lock.

The fourth telescopic stanchion 134 further comprises a fourth plate 341, a fourth 90-degree elbow tee 342, and a fourth compression spring 343. The fourth plate 341 is a disk-shaped plate structure. The fourth plate 341 forms a pedestal between the twelfth arm 212 of the fourth telescopic stanchion 134 and the ground. The fourth 90-degree elbow tee 342 is an elbow tee that forms the superior structure of the fourth telescopic stanchion 134. The fourth 90-degree elbow tee 342 attaches the tenth arm 210 of the fourth telescopic stanchion 134 to the fourth beam 144 and the third beam 143. The fourth compression spring 343 is a helical spring. The fourth compression spring 343 is a coil spring that forms a compression spring. The fourth compression spring 343 absorbs shocks within the fourth telescopic stanchion 134 that occur when the framework 101 installs in the negative space 106.

The first arm 201 is further defined with a first end 401 and a second end 402. The second arm 202 is further defined with a third end 403 and a fourth end 404. The third arm 203 is further defined with a fifth end 405 and a sixth end 406. The fourth arm 204 is further defined with a seventh end 407 and an eighth end 408. The fifth arm 205 is further defined with a ninth end 409 and a tenth end 410. The sixth arm 206 is further defined with an eleventh end 411 and a twelfth end 412.

The seventh arm 207 is further defined with a thirteenth end 413 and a fourteenth end 414. The eighth arm 208 is further defined with a fifteenth end 415 and a sixteenth end 416. The ninth arm 209 is further defined with a seventeenth end 417 and an eighteenth end 418. The tenth arm 210 is further defined with a nineteenth end 419 and a twentieth end 420. The eleventh arm 211 is further defined with a twenty-first end 421 and a twenty-second end 422. The twelfth arm 212 is further defined with a twenty-third end 423 and a twenty-fourth end 424.

The first 90-degree elbow tee 312 is further defined with a fifty-seventh end 457, a fifty-eighth end 458, and a fifty-ninth end 459. The second 90-degree elbow tee 322 is further defined with a sixtieth end 460, a sixty-first end 461, and a sixty-second end 462. The third 90-degree elbow tee 332 is further defined with a sixty-third end 463, a sixty-fourth end 464, and a sixty-fifth end 465. The fourth 90-degree elbow tee 342 is further defined with a sixty-sixth end 466, a sixty-seventh end 467, and a sixty-eighth end 468.

Each of the plurality of beams 112 is a jib used to suspend the tarpaulin 102. Each of the plurality of beams 112 is a horizontally oriented structure. Each of the plurality of beams 112 is a telescopic structure. The span of the length of each of the plurality of beams 112 is adjustable in a direction selected from the group consisting of: a) the primary sense of direction 172; b), the lateral direction 173; and c) a horizontal direction formed in a direction that is perpendicular to neither the primary sense of direction 172 nor the lateral direction 173. The plurality of beams 112 forms the superior structure of the invention 100. The plurality of beams 112 comprises a first beam 141, a second beam 142, a third beam 143, and a fourth beam 144.

A portion of the tarpaulin 102 hangs from the first beam 141. The first beam 141 is a horizontally oriented load bearing structure. The first beam 141 is a telescopic structure. The first beam 141 comprises a first telescopic jib 161 and a second telescopic jib 162. The first telescopic jib 161 is a telescopic structure. The first telescopic jib 161 attaches the first beam 141 to the first telescopic stanchion 131. The second telescopic jib 162 is a telescopic structure. The second telescopic jib 162 attaches the first beam 141 to the second telescopic stanchion 132.

The first telescopic jib 161 is a telescopic structure that comprises a thirteenth arm 213, a fourteenth arm 214, and a ninth detent 239. The ninth detent 239 is a mechanical device that locks and secures the fourteenth arm 214 to the thirteenth arm 213. The thirteenth arm 213 is a hollow prism that is further defined with an inner dimension. The fourteenth arm 214 is a hollow prism that is further defined with an outer dimension. The fourteenth arm 214 is geometrically similar to the thirteenth arm 213. The span of the outer dimension of the fourteenth arm 214 is lesser than the span of the inner dimension of the thirteenth arm 213 such that the fourteenth arm 214 inserts into the thirteenth arm 213 in a telescopic fashion.

This telescopic arrangement of the first telescopic jib 161 allows the length of the first telescopic jib 161 to adjust by adjusting the relative position of the fourteenth arm 214 within the thirteenth arm 213. The position of the fourteenth arm 214 relative to the thirteenth arm 213 is held in position using the ninth detent 239. The ninth detent 239 is selected from the group consisting of a cotter pin, a G snap collar, a cam lock collar, a threaded clutch, a split collar lock, and a spring-loaded ball lock.

The second telescopic jib 162 is a telescopic structure that comprises a fifteenth arm 215, a sixteenth arm 216, and a tenth detent 240. The tenth detent 240 is a mechanical device that locks and secures the sixteenth arm 216 to the fifteenth arm 215. The fifteenth arm 215 is a hollow prism that is further defined with an inner dimension. The sixteenth arm 216 is a hollow prism that is further defined with an outer dimension. The sixteenth arm 216 is geometrically similar to the fifteenth arm 215. The span of the outer dimension of the sixteenth arm 216 is lesser than the span of the inner dimension of the fifteenth arm 215 such that the sixteenth arm 216 inserts into the fifteenth arm 215 in a telescopic fashion.

This telescopic arrangement of the second telescopic jib 162 allows the length of the second telescopic jib 162 to adjust by adjusting the relative position of the sixteenth arm 216 within the fifteenth arm 215. The position of the sixteenth arm 216 relative to the fifteenth arm 215 is held in position using the tenth detent 240. The tenth detent 240 is selected from the group consisting of a cotter pin, a G snap collar, a cam lock collar, a threaded clutch, a split collar lock, and a spring-loaded ball lock.

A portion of the tarpaulin 102 hangs from the second beam 142. The second beam 142 is a horizontally oriented load bearing structure. The second beam 142 is a telescopic structure. The second beam 142 comprises a third telescopic jib 163 and a fourth telescopic jib 164. The third telescopic jib 163 is a telescopic structure. The third telescopic jib 163 attaches the second beam 142 to the second telescopic stanchion 132. The fourth telescopic jib 164 is a telescopic structure. The fourth telescopic jib 164 attaches the second beam 142 to the third telescopic stanchion 133.

The third telescopic jib 163 is a telescopic structure that comprises a seventeenth arm 217, an eighteenth arm 218, and an eleventh detent 241. The eleventh detent 241 is a mechanical device that locks and secures the eighteenth arm 218 to the seventeenth arm 217. The seventeenth arm 217 is a hollow prism that is further defined with an inner dimension. The eighteenth arm 218 is a hollow prism that is further defined with an outer dimension. The eighteenth arm 218 is geometrically similar to the seventeenth arm 217. The span of the outer dimension of the eighteenth arm 218 is lesser than the span of the inner dimension of the seventeenth arm 217 such that the eighteenth arm 218 inserts into the seventeenth arm 217 in a telescopic fashion.

This telescopic arrangement of the third telescopic jib 163 allows the length of the third telescopic jib 163 to adjust by adjusting the relative position of the eighteenth arm 218 within the seventeenth arm 217. The position of the eighteenth arm 218 relative to the seventeenth arm 217 is held in position using the eleventh detent 241. The eleventh detent 241 is selected from the group consisting of a cotter pin, a G snap collar, a cam lock collar, a threaded clutch, a split collar lock, and a spring-loaded ball lock.

The fourth telescopic jib 164 is a telescopic structure that comprises a nineteenth arm 219, a twentieth arm 220, and a twelfth detent 242. The twelfth detent 242 is a mechanical device that locks and secures the twentieth arm 220 to the nineteenth arm 219. The nineteenth arm 219 is a hollow prism that is further defined with an inner dimension. The twentieth arm 220 is a hollow prism that is further defined with an outer dimension. The twentieth arm 220 is geometrically similar to the nineteenth arm 219. The span of the outer dimension of the twentieth arm 220 is lesser than the span of the inner dimension of the nineteenth arm 219 such that the twentieth arm 220 inserts into the nineteenth arm 219 in a telescopic fashion.

This telescopic arrangement of the fourth telescopic jib 164 allows the length of the fourth telescopic jib 164 to adjust by adjusting the relative position of the twentieth arm 220 within the nineteenth arm 219. The position of the twentieth arm 220 relative to the nineteenth arm 219 is held in position using the twelfth detent 242. The twelfth detent 242 is selected from the group consisting of a cotter pin, a G snap collar, a cam lock collar, a threaded clutch, a split collar lock, and a spring-loaded ball lock.

A portion of the tarpaulin 102 hangs from the third beam 143. The third beam 143 is a horizontally oriented load bearing structure. The third beam 143 is a telescopic structure. The third beam 143 comprises a fifth telescopic jib 165 and a sixth telescopic jib 166. The fifth telescopic jib 165 is a telescopic structure. The fifth telescopic jib 165 attaches the third beam 143 to the third telescopic stanchion 133. The sixth telescopic jib 166 is a telescopic structure. The sixth telescopic jib 166 attaches the third beam 143 to the fourth telescopic stanchion 134.

The fifth telescopic jib 165 is a telescopic structure that comprises a twenty-first arm 221, a twenty-second arm 222, and a thirteenth detent 243. The thirteenth detent 243 is a mechanical device that locks and secures the twenty-second arm 222 to the twenty-first arm 221. The twenty-first arm 221 is a hollow prism that is further defined with an inner dimension. The twenty-second arm 222 is a hollow prism that is further defined with an outer dimension. The twenty-second arm 222 is geometrically similar to the twenty-first arm 221. The span of the outer dimension of the twenty-second arm 222 is lesser than the span of the inner dimension of the twenty-first arm 221 such that the twenty-second arm 222 inserts into the twenty-first arm 221 in a telescopic fashion.

This telescopic arrangement of the fifth telescopic jib 165 allows the length of the fifth telescopic jib 165 to adjust by adjusting the relative position of the twenty-second arm 222 within the twenty-first arm 221. The position of the twenty-second arm 222 relative to the twenty-first arm 221 is held in position using the thirteenth detent 243. The thirteenth detent 243 is selected from the group consisting of a cotter pin, a G snap collar, a cam lock collar, a threaded clutch, a split collar lock, and a spring-loaded ball lock.

The sixth telescopic jib 166 is a telescopic structure that comprises a twenty-third arm 223, a twenty-fourth arm 224, and a fourteenth detent 244. The fourteenth detent 244 is a mechanical device that locks and secures the twenty-fourth arm 224 to the twenty-third arm 223. The twenty-third arm 223 is a hollow prism that is further defined with an inner dimension. The twenty-fourth arm 224 is a hollow prism that is further defined with an outer dimension. The twenty-fourth arm 224 is geometrically similar to the twenty-third arm 223. The span of the outer dimension of the twenty-fourth arm 224 is lesser than the span of the inner dimension of the twenty-third arm 223 such that the twenty-fourth arm 224 inserts into the twenty-third arm 223 in a telescopic fashion.

This telescopic arrangement of the sixth telescopic jib 166 allows the length of the sixth telescopic jib 166 to adjust by adjusting the relative position of the twenty-fourth arm 224 within the twenty-third arm 223. The position of the twenty-fourth arm 224 relative to the twenty-third arm 223 is held in position using the fourteenth detent 244. The fourteenth detent 244 is selected from the group consisting of a cotter pin, a G snap collar, a cam lock collar, a threaded clutch, a split collar lock, and a spring-loaded ball lock.

A portion of the tarpaulin 102 hangs from the fourth beam 144. The fourth beam 144 is a horizontally oriented load bearing structure. The fourth beam 144 is a telescopic structure. The fourth beam 144 comprises a seventh telescopic jib 167 and an eighth telescopic jib 168. The seventh telescopic jib 167 is a telescopic structure. The seventh telescopic jib 167 attaches the fourth beam 144 to the fourth telescopic stanchion 134. The eighth telescopic jib 168 is a telescopic structure. The eighth telescopic jib 168 attaches the fourth beam 144 to the first telescopic stanchion 131.

The seventh telescopic jib 167 is a telescopic structure that comprises a twenty-fifth arm 225, a twenty-sixth arm 226, and a fifteenth detent 245. The fifteenth detent 245 is a mechanical device that locks and secures the twenty-sixth arm 226 to the twenty-fifth arm 225. The twenty-fifth arm 225 is a hollow prism that is further defined with an inner dimension. The twenty-sixth arm 226 is a hollow prism that is further defined with an outer dimension. The twenty-sixth arm 226 is geometrically similar to the twenty-fifth arm 225. The span of the outer dimension of the twenty-sixth arm 226 is lesser than the span of the inner dimension of the twenty-fifth arm 225 such that the twenty-sixth arm 226 inserts into the twenty-fifth arm 225 in a telescopic fashion.

This telescopic arrangement of the seventh telescopic jib 167 allows the length of the seventh telescopic jib 167 to adjust by adjusting the relative position of the twenty-sixth arm 226 within the twenty-fifth arm 225. The position of the twenty-sixth arm 226 relative to the twenty-fifth arm 225 is held in position using the fifteenth detent 245. The fifteenth detent 245 is selected from the group consisting of a cotter pin, a G snap collar, a cam lock collar, a threaded clutch, a split collar lock, and a spring-loaded ball lock.

The eighth telescopic jib 168 is a telescopic structure that comprises a twenty-seventh arm 227, a twenty-eighth arm 228, and a sixteenth detent 246. The sixteenth detent 246 is a mechanical device that locks and secures the twenty-eighth arm 228 to the twenty-seventh arm 227. The twenty-seventh arm 227 is a hollow prism that is further defined with an inner dimension. The twenty-eighth arm 228 is a hollow prism that is further defined with an outer dimension. The twenty-eighth arm 228 is geometrically similar to the twenty-seventh arm 227. The span of the outer dimension of the twenty-eighth arm 228 is lesser than the span of the inner dimension of the twenty-seventh arm 227 such that the twenty-eighth arm 228 inserts into the twenty-seventh arm 227 in a telescopic fashion.

This telescopic arrangement of the eighth telescopic jib 168 allows the length of the eighth telescopic jib 168 to adjust by adjusting the relative position of the twenty-eighth arm 228 within the twenty-seventh arm 227. The position of the twenty-eighth arm 228 relative to the twenty-seventh arm 227 is held in position using the sixteenth detent 246. The sixteenth detent 246 is selected from the group consisting of a cotter pin, a G snap collar, a cam lock collar, a threaded clutch, a split collar lock, and a spring-loaded ball lock.

The thirteenth arm 213 is further defined with a twenty-fifth end 425 and a twenty-sixth end 426. The fourteenth arm 214 is further defined with a twenty-seventh end 427 and a twenty-eighth end 428. The fifteenth arm 215 is further defined with a twenty-ninth end 429 and a thirtieth end 430. The sixteenth arm 216 is further defined with a thirty-first end 431 and a thirty-second end 432. The seventeenth arm 217 is further defined with a thirty-third end 433 and a thirty-fourth end 434. The eighteenth arm 218 is further defined with a thirty-fifth end 435 and a thirty-sixth end 436.

The nineteenth arm 219 is further defined with a thirty-seventh end 437 and a thirty-eighth end 438. The twentieth arm 220 is further defined with a thirty-ninth end 439 and a fortieth end 440. The twenty-first arm 221 is further defined with a forty-first end 441 and a forty-second end 442. The twenty-second arm 222 is further defined with a forty-third end 443 and a forty-fourth end 444. The twenty-third arm 223 is further defined with a forty-fifth end 445 and a forty-sixth end 446. The twenty-fourth arm 224 is further defined with a forty-seventh end 447 and a forty-eighth end 448.

The twenty-fifth arm 225 is further defined with a forty-ninth end 449 and a fiftieth end 450. The twenty-sixth arm 226 is further defined with a fifty-first end 451 and a fifty-second end 452. The twenty-seventh arm 227 is further defined with a fifty-third end 453 and a fifty-fourth end 454. The twenty-eighth arm 228 is further defined with a fifty-fifth end 455 and a fifty-sixth end 456.

Each of the plurality of beam links 113 attaches an initial telescopic jib of the selected beam to a subsequent telescopic jib of the selected beam. The attachment of the initial and subsequent telescopic jibs forms the selected beam. Each of the plurality of beam links 113 is a hollow prism-shaped structure. Each of the plurality of beam links 113 is geometrically similar to the initial telescopic jib and the subsequent telescopic jib such that the initial and subsequent telescopic jibs will insert into a beam link selected from the plurality of beam links 113. The plurality of beam links 113 comprises a first beam link 151, a second beam link 152, a third beam link 153, and a fourth beam link 154.

The first beam link 151 is a mechanical structure that attaches the first telescopic jib 161 to the second telescopic jib 162. The second beam link 152 is a mechanical structure that attaches the third telescopic jib 163 to the fourth telescopic jib 164. The third beam link 153 is a mechanical structure that attaches the fifth telescopic jib 165 to the sixth telescopic jib 166. The fourth beam link 154 is a mechanical structure that attaches the seventh telescopic jib 167 to the eighth telescopic jib 168.

The first beam link 151 is further defined with a sixty-ninth end 469 and a seventieth end 470. The second beam link 152 is further defined with a seventy-first end 471 and a seventy-second end 472. The third beam link 153 is further defined with a seventy-third end 473 and a seventy-fourth end 474. The fourth beam link 154 is further defined with a seventy-fifth end 475 and a seventy-sixth end 476.

The following four paragraphs describe the assembly of the plurality of telescopic stanchions 111.

The first end 401 of the first arm 201 inserts into the fifty-seventh end 457 of the first 90-degree elbow tee 312. The third end 403 of the second arm 202 inserts into the second end 402 of the first arm 201. The fifth end 405 of the third arm 203 inserts into the fourth end 404 of the second arm 202. The first plate 311 of the first telescopic stanchion 131 attaches to the sixth end 406 of the third arm 203. The first compression spring 313 of the first telescopic stanchion 131 inserts into the second arm 202.

The seventh end 407 of the fourth arm 204 inserts into the sixtieth end 460 of the second 90-degree elbow tee 322. The ninth end 409 of the fifth arm 205 inserts into the eighth end 408 of the fourth arm 204. The eleventh end 411 of the sixth arm 206 inserts into the tenth end 410 of the fifth arm 205. The second plate 321 of the second telescopic stanchion 132 attaches to the twelfth end 412 of the sixth arm 206. The second compression spring 323 of the second telescopic stanchion 132 inserts into the fifth arm 205.

The thirteenth end 413 of the seventh arm 207 inserts into the sixty-third end 463 of the third 90-degree elbow tee 332. The fifteenth end 415 of the eighth arm 208 inserts into the fourteenth end 414 of the seventh arm 207. The seventeenth end 417 of the ninth arm 209 inserts into the sixteenth end 416 of the eighth arm 208. The third plate 331 of the third telescopic stanchion 133 attaches to the eighteenth end 418 of the ninth arm 209. The third compression spring 333 of the third telescopic stanchion 133 inserts into the eighth arm 208.

The nineteenth end 419 of the tenth arm 210 inserts into the sixty-sixth end 466 of the fourth 90-degree elbow tee 342. The twenty-first end 421 of the eleventh arm 211 inserts into the twentieth end 420 of the tenth arm 210. The twenty-third end 423 of the twelfth arm 212 inserts into the twenty-second end 422 of the eleventh arm 211. The fourth plate 341 of the fourth telescopic stanchion 134 attaches to the twenty-fourth end 424 of the twelfth arm 212. The fourth compression spring 343 of the fourth telescopic stanchion 134 inserts into the eleventh arm 211.

The following four paragraphs describe the assembly of the plurality of beams 112.

The twenty-fifth end 425 of the thirteenth arm 213 inserts into the fifty-ninth end 459 of the first 90-degree elbow tee 312. The twenty-seventh end 427 of the fourteenth arm 214 inserts into the twenty-sixth end 426 of the thirteenth arm 213. The twenty-eighth end 428 of the fourteenth arm 214 inserts into the sixty-ninth end 469 of the first beam link 151. The twenty-ninth end 429 of the fifteenth arm 215 inserts into the sixty-first end 461 of the second 90-degree elbow tee 322. The thirty-first end 431 of the sixteenth arm 216 inserts into the thirtieth end 430 of the fifteenth arm 215. The thirty-second end 432 of the sixteenth arm 216 inserts into the seventieth end 470 of the first beam link 151.

The thirty-third end 433 of the seventeenth arm 217 inserts into the sixty-second end 462 of the second 90-degree elbow tee 322. The thirty-fifth end 435 of the eighteenth arm 218 inserts into the thirty-fourth end 434 of the seventeenth arm 217. The thirty-sixth end 436 of the eighteenth arm 218 inserts into the seventy-first end 471 of the second beam link 152. The thirty-seventh end 437 of the nineteenth arm 219 inserts into the sixty-fourth end 464 of the third 90-degree elbow tee 332. The thirty-ninth end 439 of the twentieth arm 220 inserts into the thirty-eighth end 438 of the nineteenth arm 219. The fortieth end 440 of the twentieth arm 220 inserts into the seventy-second end 472 of the second beam link 152.

The forty-first end 441 of the twenty-first arm 221 inserts into the sixty-fifth end 465 of the third 90-degree elbow tee 332. The forty-third end 443 of the twenty-second arm 222 inserts into the forty-second end 442 of the twenty-first arm 221. The forty-fourth end 444 of the twenty-second arm 222 inserts into the seventy-third end 473 of the third beam link 153. The forty-fifth end 445 of the twenty-third arm 223 inserts into the sixty-seventh end 467 of the fourth 90-degree elbow tee 342. The forty-seventh end 447 of the twenty-fourth arm 224 inserts into the forty-sixth end 446 of the twenty-third arm 223. The forty-eighth end 448 of the twenty-fourth arm 224 inserts into the seventy-fourth end 474 of the third beam link 153.

The forty-ninth end 449 of the twenty-fifth arm 225 inserts into the sixty-eighth end 468 of the fourth 90-degree elbow tee 342. The fifty-first end 451 of the twenty-sixth arm 226 inserts into the fiftieth end 450 of the twenty-fifth arm 225. The fifty-second end 452 of the twenty-sixth arm 226 inserts into the seventy-fifth end 475 of the fourth beam link 154. The fifty-third end 453 of the twenty-seventh arm 227 inserts into the fifty-eighth end 458 of the first 90-degree elbow tee 312. The fifty-fifth end 455 of the twenty-eighth arm 228 inserts into the fifty-fourth end 454 of the twenty-seventh arm 227. The fifty-sixth end 456 of the twenty-eighth arm 228 inserts into the seventy-sixth end 476 of the fourth beam link 154.

The following definitions were used in this disclosure:

90 Degree Elbow Tee: As used in this disclosure, a 90 degree elbow is a three aperture fitting that attaches a first pipe, a second pipe, and a third pipe such that: 1) the center axis of the first pipe is perpendicular to the center axis of the second pipe; 2) the center axis of the second pipe is perpendicular to the center axis of the third pipe; and, 3) the center axis of the third pipe is perpendicular to the center axis of the first pipe.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Beam: As used in this disclosure, a beam is a horizontally oriented shaft that: 1) is suspended above a supporting surface; and, 2) bears a load. See jib.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Compression Spring: As used in this disclosure, a compression spring is a wire coil that resists forces attempting to compress the wire coil in the direction of the center axis of the wire coil. The compression spring will return to its original position when the compressive force is removed.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Detent: As used in this disclosure, a detent is a device for positioning and holding a first object relative to a second object such that the position of the first object relative to the second object is adjustable.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Fastener: As used in this disclosure, a fastener is a device that is used to removably attach a first object to a second object.

Ferrule: As used in this disclosure, a ferrule is a prism-shaped device that inserts into the end of a prism-shaped structure such that the center axis of the prism-shaped device is aligned with the center axis of the prism-shaped structure to form a composite prism structure. The outer diameter of the prism-shaped device is lesser than the outer diameter of the prism-shaped structure. Objects attached to the prism-shaped device are thereby attached to the prism-shaped structure.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Framework: As used in this disclosure, a framework refers to the substructure of an object that carries the load path of the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Ground: As used in this disclosure, the ground is a solid supporting surface formed by the Earth. The term level ground means that the supporting surface formed by the ground is roughly perpendicular to the force of gravity.

Helical Spring: As used in this disclosure, a helical spring is a compression spring shaped in the form of a cylindrical helix.

Hook: As used in this disclosure, a hook is an object that is curved or bent at an angle such that items can be hung on or caught by the object.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook/loop surface" with the understanding that when the two objects are fastened together one of the two objects will have a hook surface and the remaining object will have the loop surface.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Jib: As used in this disclosure, a jib is a beam structure that is used to suspend a load.

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior-posterior axis. Lateral movement is often called sideways movement.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Opaque: As used in this disclosure, opaque refers to an object or material that prevents the passage of radiation through the object or material.

Openwork: As used in this disclosure, the term open work is used to describe a structure, often a surface, which is formed with openings that allow for visibility and fluid flow through the structure. Wrought work and meshes are forms of openwork.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedestal: As used in this disclosure, a pedestal is an intermediary load bearing structure that that transfers a load path between a supporting surface and an object, structure, or load.

Perimetrical Boundary: As used in this disclosure, a perimetrical boundary is a hypothetical rectangular block that contains an object. Specifically, the rectangular block selected to be the perimetrical block is the rectangular block with the minimum volume that fully contains the object.

Pickup Truck: As used in this disclosure, a pickup truck is a vehicle having an enclosed cab and an open body comprising low sides and a tailgate that is powered by an internal combustion engine. A pickup truck is further defined with a bed, a tailgate, a left sidewall, a right sidewall, and an end wall.

Pipe: As used in this disclosure, the term pipe is used to describe a rigid hollow prism. While pipes that are suitable for use in this disclosure are often used to transport or conveys fluids or gases, the purpose of the pipes in this disclosure is structural. In this disclosure, the terms inner dimension of a pipe and outer dimension are used as they would be used by those skilled in the plumbing arts would use inner diameter and outer diameter.

Primary Sense of Direction: As used in this disclosure, the primary sense of direction of an object refers to a vector that: 1) passes through the center of the object; and, 2) is parallel to the direction of travel when the anterior surface(s) of the object are leading the object into the direction of travel. This definition intends to align with what people would normally call the forward direction of an object.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Shaft: As used in this disclosure, a shaft is a long, narrow and rigid prism structure used as: 1) a structural element of a larger object; or 2) as a grip or lever for a handle. Shafts often have a cylindrical shape.

Sheeting: As used in this disclosure, a sheeting is a material, such as a paper, textile, a plastic, or a metal foil, in the form of a thin flexible layer or layers.

Snap: As used in this disclosure, a snap is a fastener that comprises a first component and a second component. The snap is engaged by pressing the first component into or against the second component.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stanchion: As used in this disclosure, a stanchion refers to a vertical pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object.

Tarpaulin: As used in this disclosure, a tarpaulin is a protective covering made of a sheeting. The sheeting can be a textile material made from made from fibers or yarns suitable for textile production methods including, but not limited to, weaving, knitting or felting. The sheeting can also be made of material in the form of a continuous film including, but not limited to, plastic films.

Telescopic: As used in this disclosure, telescopic is an adjective that describes an object made of sections that fit or slide into each other such that the object can be made longer or shorter by adjusting the relative positions of the sections.

Textile: As used in this disclosure, a textile is a material that is woven, knitted, braided or felted. Synonyms in common usage for this definition include fabric and cloth.

Tow: As used in this disclosure, the term tow is used as a verb that refers to moving an object by pulling on the object with the assistance of an apparatus or device.

Trailer: As used in this disclosure, a trailer is an unpowered wheeled vehicle that is towed by a powered vehicle such as a tractor.

Vehicle: As used in this disclosure, a vehicle is a device used for transporting passengers, goods, or equipment. The term motorized vehicle refers to a vehicle can move under power provided by an electric motor or an internal combustion engine.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS.

1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventors claim:

1. An apparatus for a towed vehicle comprising:

a framework, a tarpaulin, and a plurality of fasteners;

wherein the plurality of fasteners attach the tarpaulin to the framework;

wherein the apparatus is configured for use with a trailer;

wherein the apparatus is configured to enclose a negative space of said trailer;

wherein the trailer is further defined with a vertical direction, a primary sense of direction, and a lateral direction;

wherein the apparatus for a towed vehicle is further defined with the vertical direction, the primary sense of direction, and the lateral direction;

wherein the vertical direction, the primary sense of direction, and the lateral direction of the apparatus for a towed vehicle aligns with the vertical direction, the primary sense of direction, and the lateral direction of the trailer;

wherein the span of the length of the vertical direction of the apparatus for a towed vehicle is adjustable such that the apparatus for a towed vehicle adjusts to match variations in the span of the vertical direction of the negative space;

wherein the span of the length of the primary sense of direction of the apparatus for a towed vehicle is adjustable such that the apparatus for a towed vehicle adjusts to match variations in the span of the primary sense of direction of the negative space;

wherein the span of the length of the lateral direction of the apparatus for a towed vehicle is adjustable such that the apparatus for a towed vehicle adjusts to match variations in the span of the lateral direction of the negative space;

wherein the framework is an openwork structure;

wherein the framework forms the boundary of a containment space;

wherein the framework forms a substructure that supports the tarpaulin;

wherein the framework forms the containment space within the boundaries of the negative space;

wherein the span of the length of the framework in the vertical direction is adjustable;

wherein the span of the length of the framework in the primary sense of direction is adjustable;

wherein the span of the length of the framework in the lateral direction is adjustable;

wherein the tarpaulin is a sheeting;

wherein the tarpaulin is formed from an opaque material;

wherein the tarpaulin attaches to the framework such that the tarpaulin prevents visibility into the containment space formed by the framework;

wherein each of the plurality of fasteners suspends the tarpaulin from the framework;

wherein each of the plurality of fasteners forms a portion of the load path the transfers the load of the tarpaulin to the framework;

wherein each of the plurality of fasteners is selected from the group consisting of a plurality of hooks, a plurality of hook and loop fasteners, and a plurality of snaps;

wherein each of the plurality of beams is a jib used to suspend the tarpaulin;

wherein each of the plurality of beams is a horizontally oriented structure;

wherein each of the plurality of beams is a telescopic structure;

wherein the span of the length of each of the plurality of beams is adjustable in a direction selected from the group consisting of: a) the primary sense of direction; b), the lateral direction; and c) a horizontal direction formed in a direction that is perpendicular to neither the primary sense of direction nor the lateral direction;

wherein the plurality of beams forms the superior structure of the apparatus for a towed vehicle;

wherein the framework comprises a plurality of telescopic stanchions, a plurality of beams, and a plurality of beam links;

wherein each of the plurality of telescopic stanchions is a vertically oriented structure;

wherein each of the plurality of telescopic stanchions is a telescopic structure;

wherein the span of the length of each of the plurality of telescopic stanchions is adjustable in the vertical direction;

wherein each of the plurality of beam links attaches an initial telescopic jib of the selected beam to a subsequent telescopic jib of the selected beam;

wherein the attachment of the initial and subsequent telescopic jibs forms the selected beam;

wherein each of the plurality of beam links is a hollow prism-shaped structure;

wherein each of the plurality of beam links is geometrically similar to the initial telescopic jib and the subsequent telescopic jib such that the initial and subsequent telescopic jibs will insert into a beam link selected from the plurality of beam links;

wherein the plurality of telescopic stanchions comprises a first telescopic stanchion, a second telescopic stanchion, a third telescopic stanchion, and a fourth telescopic stanchion;

wherein the first telescopic stanchion is a telescopic structure;

wherein the second telescopic stanchion is a telescopic structure;

wherein the third telescopic stanchion is a telescopic structure;

wherein the fourth telescopic stanchion is a telescopic structure.

2. The apparatus for a towed vehicle according to claim 1 wherein the first telescopic stanchion is a vertically oriented stanchion that carries a portion of the load path of the apparatus for a towed vehicle;

wherein the second telescopic stanchion is a vertically oriented stanchion that carries a portion of the load path of the apparatus for a towed vehicle;

wherein the third telescopic stanchion is a vertically oriented stanchion that carries a portion of the load path of the apparatus for a towed vehicle;

wherein the fourth telescopic stanchion is a vertically oriented stanchion that carries a portion of the load path of the apparatus for a towed vehicle.

3. The apparatus for a towed vehicle according to claim 2 wherein the plurality of beams comprises a first beam, a second beam, a third beam, and a fourth beam;

wherein the first beam is a telescopic structure;

wherein the second beam is a telescopic structure;

wherein the third beam is a telescopic structure;

wherein the fourth beam is a telescopic structure;

wherein the first beam is a horizontally oriented load bearing structure;

wherein the second beam is a horizontally oriented load bearing structure;

wherein the third beam is a horizontally oriented load bearing structure;

wherein the fourth beam is a horizontally oriented load bearing structure;

wherein a portion of the tarpaulin hangs from the first beam;

wherein a portion of the tarpaulin hangs from the second beam;

wherein a portion of the tarpaulin hangs from the third beam;

wherein a portion of the tarpaulin hangs from the fourth beam.

4. The apparatus for a towed vehicle according to claim 3 wherein the plurality of beam links comprises a first beam link, a second beam link, a third beam link, and a fourth beam link;

wherein the first beam link is a mechanical structure that attaches the first telescopic jib to the second telescopic jib;

wherein the second beam link is a mechanical structure that attaches the third telescopic jib to the fourth telescopic jib;

wherein the third beam link is a mechanical structure that attaches the fifth telescopic jib to the sixth telescopic jib;

wherein the fourth beam link is a mechanical structure that attaches the seventh telescopic jib to the eighth telescopic jib.

5. The apparatus for a towed vehicle according to claim 4 wherein the first beam comprises a first telescopic jib and a second telescopic jib;

wherein the second beam comprises a third telescopic jib and a fourth telescopic jib;

wherein the third beam comprises a fifth telescopic jib and a sixth telescopic jib;

wherein the fourth beam comprises a seventh telescopic jib and an eighth telescopic jib;

wherein the first telescopic jib is a telescopic structure;

wherein the second telescopic jib is a telescopic structure;

wherein the third telescopic jib is a telescopic structure;

wherein the fourth telescopic jib is a telescopic structure;

wherein the fifth telescopic jib is a telescopic structure;

wherein the sixth telescopic jib is a telescopic structure;

wherein the seventh telescopic jib is a telescopic structure;

wherein the eighth telescopic jib is a telescopic structure.

6. The apparatus for a towed vehicle according to claim 5 wherein the first telescopic jib attaches the first beam to the first telescopic stanchion;

wherein the second telescopic jib attaches the first beam to the second telescopic stanchion;

wherein the third telescopic jib attaches the second beam to the second telescopic stanchion;

wherein the fourth telescopic jib attaches the second beam to the third telescopic stanchion;

wherein the fifth telescopic jib attaches the third beam to the third telescopic stanchion;

wherein the sixth telescopic jib attaches the third beam to the fourth telescopic stanchion;

wherein the seventh telescopic jib attaches the fourth beam to the fourth telescopic stanchion;

wherein the eighth telescopic jib attaches the fourth beam to the first telescopic stanchion.

7. The apparatus for a towed vehicle according to claim 6 wherein the first telescopic stanchion comprises a first arm, a second arm, and a first detent;

wherein the first detent is a mechanical device that locks and secures the second arm to the first arm;

wherein the first arm is a hollow prism that is further defined with an inner dimension;

wherein the second arm is a hollow prism that is further defined with an outer dimension;

wherein the second arm is geometrically similar to the first arm;

wherein the span of the outer dimension of the second arm is lesser than the span of the inner dimension of the first arm such that the second arm inserts into the first arm in a telescopic fashion;

wherein the span of the length of the first telescopic stanchion adjusts by the relative position of the second arm within the first arm;

wherein the position of the second arm relative to the first arm is held in position using the first detent;

wherein the first telescopic stanchion further comprises a third arm, and a second detent;

wherein the second detent is a mechanical device that locks and secures the second arm to the third arm;

wherein the third arm is a hollow prism that is further defined with an outer dimension;

wherein the third arm is geometrically similar to the second arm;

wherein the span of the outer dimension of the third arm is lesser than the span of the inner dimension of the second arm such that the third arm inserts into the second arm in a telescopic fashion;

wherein the span of the length of the first telescopic stanchion adjusts by adjusting the relative position of the third arm within the second arm;

wherein the position of the relative to the third arm is held in position using the second detent;

wherein the second telescopic stanchion comprises a fourth arm, a fifth arm, and a third detent;

wherein the third detent is a mechanical device that locks and secures the fifth arm to the fourth arm;

wherein the fourth arm is a hollow prism that is further defined with an inner dimension;

wherein the fifth arm is a hollow prism that is further defined with an outer dimension;

wherein the fifth arm is geometrically similar to the fourth arm;

wherein the span of the outer dimension of the fifth arm is lesser than the span of the inner dimension of the fourth arm such that the fifth arm inserts into the fourth arm in a telescopic fashion;

wherein the span of the length of the second telescopic stanchion adjusts by adjusting the relative position of the fifth arm within the fourth arm;

wherein the position of the fifth arm relative to the fourth arm is held in position using the third detent;

wherein the second telescopic stanchion further comprises a sixth arm, and a fourth detent;

wherein the fourth detent is a mechanical device that locks and secures the fifth arm to the sixth arm;

wherein the fifth arm is a hollow prism that is further defined with an inner dimension;

wherein the sixth arm is a hollow prism that is further defined with an outer dimension;

wherein the sixth arm is geometrically similar to the fifth arm;

wherein the span of the outer dimension of the fifth arm is lesser than the span of the inner dimension of the sixth arm such that the sixth arm inserts into the fifth arm in a telescopic fashion;

wherein the span of the length of the second telescopic stanchion adjusts by adjusting the relative position of the sixth arm within the fifth arm;

wherein the position of the fifth arm relative to the sixth arm is held in position using the fourth detent;

wherein the third telescopic stanchion comprises a seventh arm, an eighth arm, and a fifth detent;

wherein the fifth detent is a mechanical device that locks and secures the eighth arm to the seventh arm;

wherein the seventh arm is a hollow prism that is further defined with an inner dimension;

wherein the eighth arm is a hollow prism that is further defined with an outer dimension;

wherein the eighth arm is geometrically similar to the seventh arm;

wherein the span of the outer dimension of the eighth arm is lesser than the span of the inner dimension of the seventh arm such that the eighth arm inserts into the seventh arm in a telescopic fashion;

wherein the span of the length of the third telescopic stanchion adjusts by adjusting the relative position of the eighth arm within the seventh arm;

wherein the position of the eighth arm relative to the seventh arm is held in position using the fifth detent;

wherein the third telescopic stanchion further comprises a ninth arm, and a sixth detent;

wherein the sixth detent is a mechanical device that locks and secures the eighth arm to the ninth arm;

wherein the eighth arm is a hollow prism that is further defined with an inner dimension;

wherein the ninth arm is a hollow prism that is further defined with an outer dimension;

wherein the ninth arm is geometrically similar to the eighth arm;

wherein the span of the outer dimension of the eighth arm is lesser than the span of the inner dimension of the ninth arm such that the ninth arm inserts into the eighth arm in a telescopic fashion;

wherein the span of the length of the third telescopic stanchion adjusts by adjusting the relative position of the ninth arm within the eighth arm;

wherein the position of the eighth arm relative to the ninth arm is held in position using the sixth detent;

wherein the fourth telescopic stanchion comprises a tenth arm, an eleventh arm, and a seventh detent;

wherein the seventh detent is a mechanical device that locks and secures the eleventh arm to the tenth arm;

wherein the tenth arm is a hollow prism that is further defined with an inner dimension;

wherein the eleventh arm is a hollow prism that is further defined with an outer dimension;

wherein the eleventh arm is geometrically similar to the tenth arm;

wherein the span of the outer dimension of the eleventh arm is lesser than the span of the inner dimension of the tenth arm such that the eleventh arm inserts into the tenth arm in a telescopic fashion;

wherein the span of the length of the fourth telescopic stanchion adjusts by adjusting the relative position of the eleventh arm within the tenth arm;

wherein the position of the eleventh arm relative to the tenth arm is held in position using the seventh detent;

wherein the fourth telescopic stanchion further comprises a twelfth arm, and an eighth detent;

wherein the eighth detent is a mechanical device that locks and secures the eleventh arm to the twelfth arm;

wherein the eleventh arm is a hollow prism that is further defined with an inner dimension;

wherein the twelfth arm is a hollow prism that is further defined with an outer dimension;

wherein the twelfth arm is geometrically similar to the eleventh arm;

wherein the span of the outer dimension of the eleventh arm is lesser than the span of the inner dimension of the twelfth arm such that the twelfth arm inserts into the eleventh arm in a telescopic fashion;

wherein the span of the length of the fourth telescopic stanchion adjusts by adjusting the relative position of the twelfth arm within the eleventh arm;

wherein the position of the eleventh arm relative to the twelfth arm is held in position using the eighth detent.

8. The apparatus for a towed vehicle according to claim 7 wherein the first telescopic stanchion further comprises a first plate, a first 90-degree elbow tee, and a first compression spring;

wherein the first plate is a disk-shaped plate structure;

wherein the first plate forms a pedestal between the third arm of the first telescopic stanchion and the ground;

wherein the first 90-degree elbow tee is an elbow tee that forms the superior structure of the first telescopic stanchion;

wherein the first 90-degree elbow tee attaches the first arm of the first telescopic stanchion to the first beam and the fourth beam;

wherein the first compression spring is a helical spring;

wherein the first compression spring is a coil spring that forms a compression spring;

wherein the second telescopic stanchion further comprises a second plate, a second 90-degree elbow tee, and a second compression spring;

wherein the second plate is a disk-shaped plate structure;

wherein the second plate forms a pedestal between the sixth arm of the second telescopic stanchion and the ground;

wherein the second 90-degree elbow tee is an elbow tee that forms the superior structure of the second telescopic stanchion;

wherein the second 90-degree elbow tee attaches the fourth arm of the second telescopic stanchion to the second beam and the first beam;

wherein the second compression spring is a helical spring;

wherein the second compression spring is a coil spring that forms a compression spring;

wherein the third telescopic stanchion further comprises a third plate, a third 90-degree elbow tee, and a third compression spring;

wherein the third plate is a disk-shaped plate structure;

wherein the third plate forms a pedestal between the ninth arm of the third telescopic stanchion and the ground;

wherein the third 90-degree elbow tee is an elbow tee that forms the superior structure of the third telescopic stanchion;

wherein the third 90-degree elbow tee attaches the seventh arm of the third telescopic stanchion to the third beam and the second beam;

wherein the third compression spring is a helical spring;

wherein the third compression spring is a coil spring that forms a compression spring;

wherein the fourth telescopic stanchion further comprises a fourth plate, a fourth 90-degree elbow tee, and a fourth compression spring;

wherein the fourth plate is a disk-shaped plate structure;

wherein the fourth plate forms a pedestal between the twelfth arm of the fourth telescopic stanchion and the ground;

wherein the fourth 90-degree elbow tee is an elbow tee that forms the superior structure of the fourth telescopic stanchion;

wherein the fourth 90-degree elbow tee attaches the tenth arm of the fourth telescopic stanchion to the fourth beam and the third beam;

wherein the fourth compression spring is a helical spring;

wherein the fourth compression spring is a coil spring that forms a compression spring.

9. The apparatus for a towed vehicle according to claim 8 wherein the first telescopic jib comprises a thirteenth arm, a fourteenth arm, and a ninth detent;

wherein the ninth detent is a mechanical device that locks and secures the fourteenth arm to the thirteenth arm;

wherein the thirteenth arm is a hollow prism that is further defined with an inner dimension;

wherein the fourteenth arm is a hollow prism that is further defined with an outer dimension;

wherein the fourteenth arm is geometrically similar to the thirteenth arm;

wherein the span of the outer dimension of the fourteenth arm is lesser than the span of the inner dimension of the thirteenth arm such that the fourteenth arm inserts into the thirteenth arm in a telescopic fashion;

wherein the span of the length of the first telescopic jib adjusts by adjusting the relative position of the fourteenth arm within the thirteenth arm;

wherein the position of the fourteenth arm relative to the thirteenth arm is held in position using the ninth detent;

wherein the second telescopic jib is a telescopic structure that comprises a fifteenth arm, a sixteenth arm, and a tenth detent;

wherein the tenth detent is a mechanical device that locks and secures the sixteenth arm to the fifteenth arm;

wherein the fifteenth arm is a hollow prism that is further defined with an inner dimension;

wherein the sixteenth arm is a hollow prism that is further defined with an outer dimension;

wherein the sixteenth arm is geometrically similar to the fifteenth arm;

wherein the span of the outer dimension of the sixteenth arm is lesser than the span of the inner dimension of the fifteenth arm such that the sixteenth arm inserts into the fifteenth arm in a telescopic fashion;

wherein the span of the length of the second telescopic jib adjusts by adjusting the relative position of the sixteenth arm within the fifteenth arm;

wherein the position of the sixteenth arm relative to the fifteenth arm is held in position using the tenth detent;

wherein the third telescopic jib comprises a seventeenth arm, an eighteenth arm, and an eleventh detent;

wherein the eleventh detent is a mechanical device that locks and secures the eighteenth arm to the seventeenth arm;

wherein the seventeenth arm is a hollow prism that is further defined with an inner dimension;

wherein the eighteenth arm is a hollow prism that is further defined with an outer dimension;

wherein the eighteenth arm is geometrically similar to the seventeenth arm;

wherein the span of the outer dimension of the eighteenth arm is lesser than the span of the inner dimension of the seventeenth arm such that the eighteenth arm inserts into the seventeenth arm in a telescopic fashion;

wherein the span of the length of the third telescopic jib adjusts by adjusting the relative position of the eighteenth arm within the seventeenth arm;

wherein the position of the eighteenth arm relative to the seventeenth arm is held in position using the eleventh detent;

wherein the fourth telescopic jib is a telescopic structure that comprises a nineteenth arm, a twentieth arm, and a twelfth detent;

wherein the twelfth detent is a mechanical device that locks and secures the twentieth arm to the nineteenth arm;

wherein the nineteenth arm is a hollow prism that is further defined with an inner dimension;

wherein the twentieth arm is a hollow prism that is further defined with an outer dimension;

wherein the twentieth arm is geometrically similar to the nineteenth arm;

wherein the span of the outer dimension of the twentieth arm is lesser than the span of the inner dimension of the nineteenth arm such that the twentieth arm inserts into the nineteenth arm in a telescopic fashion;

wherein the span of the length of the fourth telescopic jib adjusts by adjusting the relative position of the twentieth arm within the nineteenth arm;

wherein the position of the twentieth arm relative to the nineteenth arm is held in position using the twelfth detent;

wherein the fifth telescopic jib is a telescopic structure that comprises a twenty-first arm, a twenty-second arm, and a thirteenth detent;

wherein the thirteenth detent is a mechanical device that locks and secures the twenty-second arm to the twenty-first arm;

wherein the twenty-first arm is a hollow prism that is further defined with an inner dimension;

wherein the twenty-second arm is a hollow prism that is further defined with an outer dimension;

wherein the twenty-second arm is geometrically similar to the twenty-first arm;

wherein the span of the outer dimension of the twenty-second arm is lesser than the span of the inner dimension of the twenty-first arm such that the twenty-second arm inserts into the twenty-first arm in a telescopic fashion;

wherein the span of the length of the fifth telescopic jib adjusts by adjusting the relative position of the twenty-second arm within the twenty-first arm;

wherein the position of the twenty-second arm relative to the twenty-first arm is held in position using the thirteenth detent;

wherein the sixth telescopic jib is a telescopic structure that comprises a twenty-third arm, a twenty-fourth arm, and a fourteenth detent;

wherein the fourteenth detent is a mechanical device that locks and secures the twenty-fourth arm to the twenty-third arm;

wherein the twenty-third arm is a hollow prism that is further defined with an inner dimension;

wherein the twenty-fourth arm is a hollow prism that is further defined with an outer dimension;

wherein the twenty-fourth arm is geometrically similar to the twenty-third arm;

wherein the span of the outer dimension of the twenty-fourth arm is lesser than the span of the inner dimension of the twenty-third arm such that the twenty-fourth arm inserts into the twenty-third arm in a telescopic fashion;

wherein the span of the length of the sixth telescopic jib adjusts by adjusting the relative position of the twenty-fourth arm within the twenty-third arm;

wherein the position of the twenty-fourth arm relative to the twenty-third arm is held in position using the fourteenth detent;

wherein the seventh telescopic jib comprises a twenty-fifth arm, a twenty-sixth arm, and a fifteenth detent;

wherein the fifteenth detent is a mechanical device that locks and secures the twenty-sixth arm to the twenty-fifth arm;

wherein the twenty-fifth arm is a hollow prism that is further defined with an inner dimension;

wherein the twenty-sixth arm is a hollow prism that is further defined with an outer dimension;

wherein the twenty-sixth arm is geometrically similar to the twenty-fifth arm;

wherein the span of the outer dimension of the twenty-sixth arm is lesser than the span of the inner dimension of the twenty-fifth arm such that the twenty-sixth arm inserts into the twenty-fifth arm in a telescopic fashion;

wherein the span of the length of the seventh telescopic jib adjusts by adjusting the relative position of the twenty-sixth arm within the twenty-fifth arm;

wherein the position of the twenty-sixth arm relative to the twenty-fifth arm is held in position using the fifteenth detent;

wherein the eighth telescopic jib is a telescopic structure that comprises a twenty-seventh arm, a twenty-eighth arm, and a sixteenth detent;

wherein the sixteenth detent is a mechanical device that locks and secures the twenty-eighth arm to the twenty-seventh arm;

wherein the twenty-seventh arm is a hollow prism that is further defined with an inner dimension;

wherein the twenty-eighth arm is a hollow prism that is further defined with an outer dimension;

wherein the twenty-eighth arm is geometrically similar to the twenty-seventh arm;

wherein the span of the outer dimension of the twenty-eighth arm is lesser than the span of the inner dimension of the twenty-seventh arm such that the twenty-eighth arm inserts into the twenty-seventh arm in a telescopic fashion;

wherein the span of the length of the eighth telescopic jib adjusts by adjusting the relative position of the twenty-eighth arm within the twenty-seventh arm;

wherein the position of the twenty-eighth arm relative to the twenty-seventh arm is held in position using the sixteenth detent.

10. The apparatus for a towed vehicle according to claim 9 wherein the first arm is further defined with a first end and a second end;

wherein the second arm is further defined with a third end and a fourth end;

wherein the third arm is further defined with a fifth end and a sixth end;

wherein the fourth arm is further defined with a seventh end and an eighth end;

wherein the fifth arm is further defined with a ninth end and a tenth end;

wherein the sixth arm is further defined with an eleventh end and a twelfth end;

wherein the seventh arm is further defined with a thirteenth end and a fourteenth end;

wherein the eighth arm is further defined with a fifteenth end and a sixteenth end;

wherein the ninth arm is further defined with a seventeenth end and an eighteenth end;

wherein the tenth arm is further defined with a nineteenth end and a twentieth end;

wherein the eleventh arm is further defined with a twenty-first end and a twenty-second end;

wherein the twelfth arm is further defined with a twenty-third end and a twenty-fourth end;

wherein the first beam link is further defined with a sixty-ninth end and a seventieth end;

wherein the second beam link is further defined with a seventy-first end and a seventy-second end;

wherein the third beam link is further defined with a seventy-third end and a seventy-fourth end;

wherein the fourth beam link is further defined with a seventy-fifth end and a seventy-sixth end;

wherein the first 90-degree elbow tee is further defined with a fifty-seventh end, a fifty-eighth end, and a fifty-ninth end;

wherein the second 90-degree elbow tee is further defined with a sixtieth end, a sixty-first end, and a sixty-second end;

wherein the third 90-degree elbow tee is further defined with a sixty-third end, a sixty-fourth end, and a sixty-fifth end;

wherein the fourth 90-degree elbow tee is further defined with a sixty-sixth end, a sixty-seventh end, and a sixty-eighth end;

wherein the first end of the first arm inserts into the fifty-seventh end of the first 90-degree elbow tee;

wherein the third end of the second arm inserts into the second end of the first arm;

wherein the fifth end of the third arm inserts into the fourth end of the second arm;

wherein the first plate of the first telescopic stanchion attaches to the sixth end of the third arm;

wherein the first compression spring of the first telescopic stanchion inserts into the second arm;

wherein the seventh end of the fourth arm inserts into the sixtieth end of the second 90-degree elbow tee;

wherein the ninth end of the fifth arm inserts into the eighth end of the fourth arm;

wherein the eleventh end of the sixth arm inserts into the tenth end of the fifth arm;

wherein the second plate of the second telescopic stanchion attaches to the twelfth end of the sixth arm;

wherein the second compression spring of the second telescopic stanchion inserts into the fifth arm;

wherein the thirteenth end of the seventh arm inserts into the sixty-third end of the third 90-degree elbow tee;

wherein the fifteenth end of the eighth arm inserts into the fourteenth end of the seventh arm;

wherein the seventeenth end of the ninth arm inserts into the sixteenth end of the eighth arm;

wherein the third plate of the third telescopic stanchion attaches to the eighteenth end of the ninth arm;

wherein the third compression spring of the third telescopic stanchion inserts into the eighth arm;

wherein the nineteenth end of the tenth arm inserts into the sixty-sixth end of the fourth 90-degree elbow tee;

wherein the twenty-first end of the eleventh arm inserts into the twentieth end of the tenth arm;

wherein the twenty-third end of the twelfth arm inserts into the twenty-second end of the eleventh arm;

wherein the fourth plate of the fourth telescopic stanchion attaches to the twenty-fourth end of the twelfth arm;

wherein the fourth compression spring of the fourth telescopic stanchion inserts into the eleventh arm.

11. The apparatus for a towed vehicle according to claim 10 wherein the thirteenth arm is further defined with a twenty-fifth end and a twenty-sixth end;

wherein the fourteenth arm is further defined with a twenty-seventh end and a twenty-eighth end;

wherein the fifteenth arm is further defined with a twenty-ninth end and a thirtieth end;

wherein the sixteenth arm is further defined with a thirty-first end and a thirty-second end;

wherein the seventeenth arm is further defined with a thirty-third end and a thirty-fourth end;

wherein the eighteenth arm is further defined with a thirty-fifth end and a thirty-sixth end;

wherein the nineteenth arm is further defined with a thirty-seventh end and a thirty-eighth end;

wherein the twentieth arm is further defined with a thirty-ninth end and a fortieth end;

wherein the twenty-first arm is further defined with a forty-first end and a forty-second end;

wherein the twenty-second arm is further defined with a forty-third end and a forty-fourth end;

wherein the twenty-third arm is further defined with a forty-fifth end and a forty-sixth end;

wherein the twenty-fourth arm is further defined with a forty-seventh end and a forty-eighth end;

wherein the twenty-fifth arm is further defined with a forty-ninth end and a fiftieth end;

wherein the twenty-sixth arm is further defined with a fifty-first end and a fifty-second end;

wherein the twenty-seventh arm is further defined with a fifty-third end and a fifty-fourth end;

wherein the twenty-eighth arm is further defined with a fifty-fifth end and a fifty-sixth end;

wherein the twenty-fifth end of the thirteenth arm inserts into the fifty-ninth end of the first 90-degree elbow tee;

wherein the twenty-seventh end of the fourteenth arm inserts into the twenty-sixth end of the thirteenth arm;

wherein the twenty-eighth end of the fourteenth arm inserts into the sixty-ninth end of the first beam link;

wherein the twenty-ninth end of the fifteenth arm inserts into the sixty-first end of the second 90-degree elbow tee;

wherein the thirty-first end of the sixteenth arm inserts into the thirtieth end of the fifteenth arm;

wherein the thirty-second end of the sixteenth arm inserts into the seventieth end of the first beam link;

wherein the thirty-third end of the seventeenth arm inserts into the sixty-second end of the second 90-degree elbow tee;

wherein the thirty-fifth end of the eighteenth arm inserts into the thirty-fourth end of the seventeenth arm;

wherein the thirty-sixth end of the eighteenth arm inserts into the seventy-first end of the second beam link;

wherein the thirty-seventh end of the nineteenth arm inserts into the sixty-fourth end of the third 90-degree elbow tee;

wherein the thirty-ninth end of the twentieth arm inserts into the thirty-eighth end of the nineteenth arm;

wherein the fortieth end of the twentieth arm inserts into the seventy-second end of the second beam link;

wherein the forty-first end of the twenty-first arm inserts into the sixty-fifth end of the third 90-degree elbow tee;

wherein the forty-third end of the twenty-second arm inserts into the forty-second end of the twenty-first arm;

wherein the forty-fourth end of the twenty-second arm inserts into the seventy-third end of the third beam link;

wherein the forty-fifth end of the twenty-third arm inserts into the sixty-seventh end of the fourth 90-degree elbow tee;

wherein the forty-seventh end of the twenty-fourth arm inserts into the forty-sixth end of the twenty-third arm;

wherein the forty-eighth end of the twenty-fourth arm inserts into the seventy-fourth end of the third beam link;

wherein the forty-ninth end of the twenty-fifth arm inserts into the sixty-eighth end of the fourth 90-degree elbow tee;

wherein the fifty-first end of the twenty-sixth arm inserts into the fiftieth end of the twenty-fifth arm;

wherein the fifty-second end of the twenty-sixth arm inserts into the seventy-fifth end of the fourth beam link;

wherein the fifty-third end of the twenty-seventh arm inserts into the fifty-eighth end of the first 90-degree elbow tee;

wherein the fifty-fifth end of the twenty-eighth arm inserts into the fifty-fourth end of the twenty-seventh arm;

wherein the fifty-sixth end of the twenty-eighth arm inserts into the seventy-sixth end of the fourth beam link.

* * * * *